US005812158A

United States Patent [19]

Murthy et al.

[11] Patent Number: 5,812,158

[45] Date of Patent: Sep. 22, 1998

[54] COATED NOZZLE PLATE FOR INK JET PRINTING

[75] Inventors: Ashok Murthy; Gary Raymond Williams, both of Lexington, Ky.

[73] Assignee: Lexmark International, Inc., Lexington, Ky.

[21] Appl. No.: 588,501

[22] Filed: Jan. 18, 1996

[51] Int. Cl.[6] ..... B41J 2/135; B41J 2/14; B41J 2/05

[52] U.S. Cl. ..... 347/45; 347/47; 347/63

[58] Field of Search ..... 347/45, 47, 63, 347/64, 65; 428/626

[56] References Cited

U.S. PATENT DOCUMENTS

| | | | |
|---|---|---|---|
| 4,392,907 | 7/1983 | Shirato et al. | 156/252 |
| 4,609,427 | 9/1986 | Inamoto et al. | 156/633 |
| 4,707,705 | 11/1987 | Hara et al. | 346/75 |
| 5,334,999 | 8/1994 | Kashiwazaki et al. | 347/65 |
| 5,350,616 | 9/1994 | Pan et al. | 428/131 |
| 5,426,458 | 6/1995 | Wenzel et al. | 347/45 |
| 5,434,607 | 7/1995 | Keefe | 347/50 |
| 5,439,728 | 8/1995 | Morozumi et al. | 428/136 |
| 5,450,109 | 9/1995 | Hock | 347/67 |
| 5,455,612 | 10/1995 | Ikeda et al. | 347/64 |
| 5,493,320 | 2/1996 | Sandbach, Jr. et al. | 347/47 |
| 5,502,470 | 3/1996 | Miyashita et al. | 347/45 |
| 5,600,349 | 2/1997 | Keefe | 347/11 |
| 5,635,968 | 6/1997 | Bhaskar et al. | 347/59 |

FOREIGN PATENT DOCUMENTS 0 638 602 A1 of 0000 European Pat. Off. ..... C08G 61/02

*Primary Examiner*—Safet Metjahic
*Assistant Examiner*—Christopher Mahoney
*Attorney, Agent, or Firm*—John A. Brady

[57] ABSTRACT

A nozzle plate for an ink jet print head which is coated with a low surface energy polymer with the attaching surface further coated by tantalum in a thickness range of 50 to 500 Angstroms. The tantalum gives excellent attachment over a wide range of environments. A master sheet of individual nozzle plates is first coated by chemical vapor deposition and then sputter coated with tantalum on the attachment side. These are quite inexpensive and avoids the use of a more expensive gold coating.

24 Claims, 1 Drawing Sheet

COATED NOZZLE PLATE FOR INK JET PRINTING

RELATED APPLICATION

Much of the content of this application is disclosed in pending U.S. patent application Ser. No. 08/342,532, filed Nov. 21, 1994 by the inventors of this application. Additional matter in this application relates to an additional tantalum coating.

FIELD OF THE INVENTION

The present invention is concerned with nozzle plates for ink jet printing.

The plates are coated to improve properties.

BACKGROUND OF THE INVENTION

It has been believed that although the outside surface of a nozzle plate used in ink jet printing has to have a low surface energy, the inside surface of the nozzle holes needs to have a high surface energy. This has been considered desirable because the high surface energy causes the ink to wick up into the firing chamber faster, thereby allowing a higher firing rate and also controlling the drop masses of the ejected drop. Most ink jet nozzle plates consist of an electroformed nickel core that is plated with gold. The gold serves to protect the nickel from corrosion caused by the ink. However, gold is relatively expensive, and does not have ideal wetting characteristics with the ink. The surface tension of the gold surface tends to lead to buildup of ink around the nozzle holes. This buildup can interfere with the ejection of droplets from the nozzle, giving increased misdirection of the drop and more satellite droplets. Both decrease print quality.

It is desirable that the front surface of the nozzle plate has a low surface energy to avoid these problems. Furthermore, it is also desirable that the nozzle plate cost as little as possible.

In order to attempt to compensate for some of these problems, the machine print algorithm has to include a high frequency of maintenance cycles wherein the printhead had to be serviced. Excessive maintenance results in higher cost and lower print speed.

As indicated in the foregoing related application and in European Patent Application 638 602 A1 to Hewlett Packard Co. the nozzle plates are made using an electroforming nickel process by plating up nickel on top of a photomask and then peeling the nickel layer off the mask. The nickel nozzle plate sheet thus formed is then coated with a thin layer of poly-p-xylylene (trademarked as Parylene). However, there are problems in adhering a Parylene coated nozzle plate to the polymer material used to form the ink flow channels on ink jet printheads. It is imperative that the nozzle plate adhere well to this polymer layer to avoid ink leaks and degradation of print quality over the life of the ink jet printhead. The printhead assembly may experience a wide range of temperatures and other environmental use condition over life. Environmental testing shows that the Parylene to polymer interface can and does fail, particularly at temperatures below 0° C., causing leakage.

The Parylene coating has a relatively slick, non-wetting surface that does not easily adhere to other materials. It is also relatively chemically inert, which makes it difficult to form chemical bonds to it. Typical approaches to improving bonding include use of adhesion promotion agents such as silanes, and use of plasma and UV/ozone treatments to change the surface energy and wetting characteristics of the material. These approaches have not proven to be as effective as the technique disclosed herein in promoting adhesion of the nozzle plate to the polymer material used to form the ink flow channels. Use of these approaches on an ink jet nozzle plate may have detrimental effects on print quality due to the fact that any treatment of the nozzle plate changes the surface wetting characteristics of the nozzle plate and thus changes how the ink interacts with the nozzle plate. Any treatment at this state also means another step in the manufacturing process, adding cost to the product.

This invention employs tantalum as an adhesion layer. Prior art use of tantalum as an adhesion layer to a gold nozzle plate sheet is disclosed in U.S. Pat. No. 5,493,320, filed Sept. 26, 1994, by D. L. Sandbach, Jr. et al, entitled "Ink Jet Printing Nozzle Array Bonded to a Polymer Ink Barrier Layer" and assigned to the assignee to which this application is assigned.

DISCLOSURE OF THE INVENTION

In this invention, the Parylene coated nozzle plate sheet, comprised of several hundred individual nozzle plates is are placed in sputtering chamber and sputter coated with tantalum to a thickness in the range of 50 to 500 Angstroms. The sputtering process is a high vacuum, line of sight process which ensures that the coating all happens only on one surface of the nozzle plate including within the nozzle holes. This surface is the inner surface of the plate sheet containing the nozzle holes, the side that abuts the silicon chip and its thick film coating. No tantalum is deposited on the other side of the nozzle plate, which is the outside surface. Thus the ink repellency property of the Parylene coating is preserved on the exposed surface of the nozzle plate. This is a desirable feature. The presence of tantalum on the inner surface has been found to markedly improve adhesion of the nozzle plate to the thick film on the silicon chip. The bond thus formed is good enough that the previously described problems of ink leakage under temperature excursion are entirely eliminated. Additionally, the tantalum coating is a batch operation that can be performed on several thousand of nozzle plates at the same time. The sheet is then separated into individual nozzle plates by dicing. The additional cost of tantalum coating is in the range of approximately 5 cents per nozzle plate. This cost addition is more than compensated by the cost reduction affected by the use Parylene instead of gold which the usual coating material known in the art.

DESCRIPTION OF THE DRAWING

Understanding of the invention will be helped by reference to the accompanying DRAWING to an embodiment of the invention. The DRAWING is a cross section, not to scale, of an ink jet printhead. Reference numeral 1 is the nozzle plate, which may be of, for example, nickel; 3 is a polyxylylene layer which covers the nozzle plate; 5 is a layer of tantalum bonded to the polyxylylene layer on the inner side, including the inside of nozzle hole 7; 9 is a polymer ink barrier layer; and 11 is a heater chip.

BEST MODE FOR CARRYING OUT THE INVENTION

Figure 1:
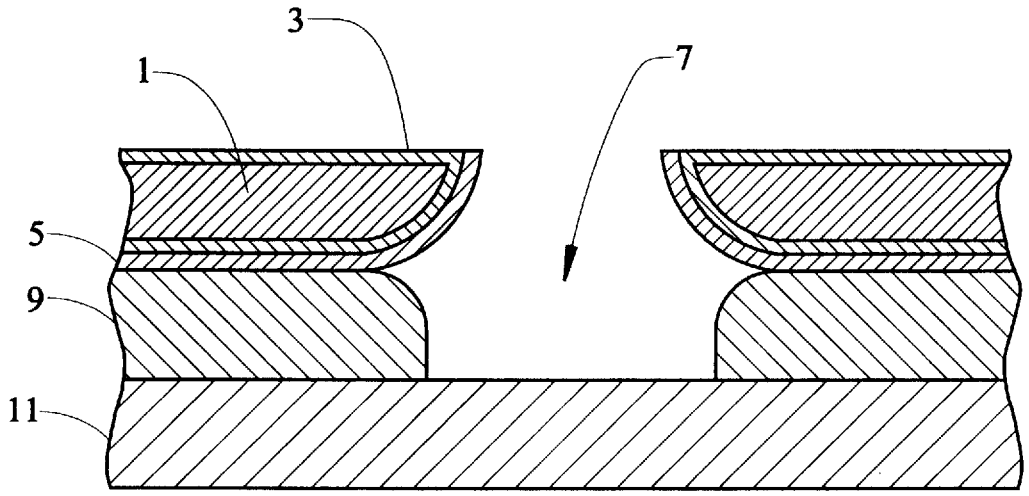

According to the present invention, a low surface energy coating 3 is applied to both the inside and the outside surfaces of the nozzle plate 1. The inside surface is then overcoated with a sputtered coating 5 of tantalum that improves adhesion of the nozzle plate 1 to the polymer coating 9 on the chip 11 that is used to form ink flow channels. The outside surface remains coated with the low energy material. This reduced surface energy on the outside surface results in the following effects:

a) The ink tends not to come out on the outer nozzle plate surface, hence there is little or no 'flooding';

b) Since there is no flooding, there is a lesser incidence of misdirected or missing nozzle fires;

c) Since there is less misdirection, there is less splatter and therefore a cleaner print;

d) Maintenance frequency is somewhat to greatly reduced, improving the throughput and page count of the printer and printhead.

e) Considerable cost savings are realized from the polyxylylene coating instead of the gold-tantalum coating it replaces.

The low energy surface coating 3 is a polymer. This polymer may include a polyolefin, a poly-(halogenated olefin) or a polyxylylene. The preferred materials are the poly-(para-xylylenes). The most preferred polymer is poly-(monochloro-para-xylylene), which is commercially available under the trademark Parylene-C from Specialty Coating Systems, a former division of Union Carbide.

It is difficult to coat the inside surfaces of the holes in the nozzle plate 1 because they are so small. It is necessary that the coating be uniform and smooth and not clog any of the holes. To obtain the desired uniform coating, the most preferred way is by a vapor deposition technique. Parylene-C is particularly suitable for chemical vapor deposition, and is the most preferred coating for this reason among others. Chemical vapor deposition, as used herein, refers to a process by which a monomer gas heterogeneously nucleates and forms a polymer film on any and all surfaces it comes in contact with. The term "vacuum deposition" is also used for this process by providers of Parylene-C. Parylene-C, when applied by chemical vapor deposition, yields none of the shape distortions typical of liquid based deposition techniques. In addition, the material is extremely inert chemically, and can withstand the high temperatures used in chip, nozzle plate, and cartridge assembly. Furthermore, this polymer has high hydrolytic stability, low moisture absorbance and low diffusion rates for moisture and oxygen. It is thus an excellent barrier material for preventing corrosion in the underlying base metal, usually nickel.

While it is not necessary for the nozzle plate 1 to function, it is essential for the durability of the nozzle plate 1 that the polymer coating 3 adhere to it. This is accomplished by the use of an adhesion promoter, many of which are commercially available. The preferred type of adhesion promoter for use in the present invention is a silane. One such is Z6032, available from Dow Corning.

A nickel nozzle sheet is dipped into 0.1M HCl for 15 minutes. It is then rinsed with deionized water, and then with ethanol. The nozzle sheet is dipped in a 0.25% to 1% solution of the silane adhesion promoter Z6032 for 15 minutes, and hung up to dry in quiescent air. When dry, the sheet is placed in a Parylene coating vacuum chamber and coated with Parylene-C to a thickness of about 1.5 microns. (This coating step is conventional, and is described in detail in the equipment manual from Specialty Coating Systems, the manufacturer of the coater). The sputtering process with tantalum as described above is carried out.

The nozzle plate sheet is then ready for the usual assembly steps. The the side having tatalum coating 5 is firmly attached by applying heat and pressure to the thick film 9 on the heater chip 11 surface. Attachment to the thick film 9 on a semiconductive silicon heater chip 11 is excellent over a wide environment ranging of temperatures. The side of the nozzle plate 1 opposite the side having tantalum coating 5 contains the ink-ejecting sides of the nozzle holes 7.

The thickness of the polymer coating 3 is not a critical feature of the invention. A thickness of less than a micron is sufficient to work, but in general it is preferred that, for the sake of durability, the thickness be somewhere up to five microns.

In summary, the present invention advances the art by providing nozzle plates 1 which have less leaking, need less maintenance, give better print quality, have good wear resistance, and excellent resistance to a wide range of temperatures.

What is claimed is:

1. A nozzle plate for an ink jet print head having a heater chip, said nozzle plate having an internal body and said nozzle plate including nozzle holes extending between an outside surface and an inside surface to be attached to said heater chip, and being characterized by said outside surface having a coating on said internal body of a polymer having a slick outer surface and said inside surface having a coating on said inner body of said polymer and a metal coating on said polymer coating said inside surface.

2. A nozzle plate as in claim 1 in which said polymer is a polyolefin, a poly -(halogenated olefin), or a polyxylylene.

3. A nozzle plate as in claim 2 in which said metal coating is tantalum of a thickness in the range of 50 to 500 Angstroms.

4. A nozzle plate as in claim 1 in which said polymer is a poly-(paraxylylene).

5. A nozzle plate as in claim 4 in which said metal coating is tantalum of a thickness in the range of 50 to 500 Angstroms.

6. A nozzle plate as in claim 1 in which said polymer is a poly (monochloro-para-xylylene).

7. A nozzle plate as in claim 6 in which said metal coating is tantalum of a thickness in the range of 50 to 500 Angstroms.

8. A nozzle plate as in claim 1 in which said metal coating is tantalum of a thickness in the range of 50 to 500 Angstroms.

9. A nozzle plate for an ink jet print head having a heater chip, said nozzle plate having an internal body and said nozzle plate including nozzle holes, an inside surface to be attached to said heater chip, and an opposite side having the ink-ejecting sides of said nozzle holes and being characterized by substantially the entire of said inside surface, said opposite side, and said nozzle holes of said internal body having a coating of a polymer having a slick outer surface and said inside surface to be attached having said polymer coated with a sputtered metal.

10. A nozzle plate as in claim 9 in which said polymer is a polyolefin, a poly - (halogenated olefin), or a polyxylylene.

11. A nozzle plate as in claim 10 in which said metal coating is tantalum of a thickness in the range of 50 to 500 Angstroms.

12. A nozzle plate as in claim 9 in which said polymer is a poly-(para-xylylene).

13. A nozzle plate as in claim 12 in which said metal coating is tantalum of a thickness in the range of 50 to 500 Angstroms.

14. A nozzle plate as in claim 9 in which said polymer is a poly-(monochloro-para-xylylene).

15. A nozzle plate as in claim 14 in which said metal coating is tantalum of a thickness in the range of 50 to 500 Angstroms.

16. A nozzle plate as in claim 9 in which said metal coating is tantalum of a thickness in the range of 50 to 500 Angstroms.

17. A method of making a nozzle plates comprising depositing by chemical vapor disposition on a sheet comprising at least two hundred individual nozzle plates a coating of a polymer on substantially all of the outside surfaces and the nozzle holes of said sheet, coating with a metal by line of sight sputtering the side of said sheet opposite the ink-ejecting side of said nozzle holes, leaving the polymer on the side of the said sheet having the ink-ejecting side of said nozzle holes, and then separating said sheet into individual nozzle plates.

18. A method as in claim 17 in which said polymer is a polyolefin, a poly -(halogenated olefin), or a polyxylylene.

19. A method as in claim 18 in which said metal is tantalum and said coating of said metal is to a thickness in the range of 50 to 500 Angstroms.

20. A method as in claim 17 in which said polymer is a poly-(paraxylylene).

21. A method as in claim 20 in which said metal is tantalum and said coating of said metal is to a thickness in the range of 50 to 500 Angstroms.

22. A method as in claim 17 in which said polymer is a poly-(monochloropara-xylylene).

23. A method as in claim 22 in which said metal is tantalum and said coating of said metal is to a thickness in the range of 50 to 500 Angstroms.

24. A method as in claim 17 in which said metal is tantalum and said coating of said metal is to a thickness in the range of 50 to 500 Angstroms.

* * * * *